United States Patent [19]

Martin et al.

[11] Patent Number: 4,854,314

[45] Date of Patent: Aug. 8, 1989

[54] SAFETY PILLOW FOR PREVENTING SMOKE INHALATION

[76] Inventors: Roy E. Martin, 1202 W. Third; John H. Parr, P.O. Box 901, both of Lee's Summit, Mo. 64063; C. Gray McCullah, 9316 W. Lake Highland Dr., Dallas, Tex. 75218

[21] Appl. No.: 122,539

[22] Filed: Nov. 13, 1987

Related U.S. Application Data

[63] Continuation of Ser. No. 891,567, Aug. 7, 1986, abandoned, which is a continuation-in-part of Ser. No. 770,990, Aug. 30, 1985, abandoned.

[51] Int. Cl.[4] ..... A62B 7/00

[52] U.S. Cl. ..... 128/205.27; 128/206.12; 128/206.19

[58] Field of Search ..... 128/205.27, 205.28, 128/205.29, 206.12, 205.25, 206.17, 206.19, 200.24, 202.13, 202.16, 206.16, 202.17, 203.12, 203.18; 55/DIG. 33, DIG. 35, DIG. 24, 524, 387, 74, 512, 513, 515, 522

[56] References Cited

U.S. PATENT DOCUMENTS

| | | | |
|---|---|---|---|
| 443,191 | 12/1890 | Illing . | |
| 533,854 | 2/1895 | Loeb . | |
| 695,403 | 3/1902 | Longden . | |
| 904,287 | 11/1908 | Warham . | |
| 1,654,925 | 1/1928 | Drager | 55/DIG. 33 |
| 1,791,229 | 2/1931 | Stampe | 128/205.29 |
| 2,261,362 | 11/1941 | Gill . | |
| 2,708,932 | 5/1955 | Pipher . | |
| 2,733,776 | 2/1956 | Garelick | 55/524 |
| 2,762,775 | 9/1956 | Foehr | 55/524 |
| 2,865,466 | 12/1958 | Frohmader | 55/524 |
| 3,107,986 | 10/1963 | Plant et al. . | |
| 3,170,969 | 2/1965 | Lerner et al. | 55/524 |
| 3,284,361 | 11/1966 | Rocchini . | |
| 3,807,144 | 4/1974 | Graybill . | |
| 3,917,469 | 11/1975 | Cotter et al. | 55/74 |
| 3,941,210 | 3/1976 | Saretzky | 55/512 |
| 4,270,933 | 6/1981 | Meny et al. | 55/524 |
| 4,402,317 | 9/1983 | Martin | 128/206.19 |
| 4,523,588 | 6/1985 | Dolsky | 128/205.29 |
| 4,682,992 | 7/1987 | Fuchs | 55/524 |

FOREIGN PATENT DOCUMENTS

| | | | |
|---|---|---|---|
| 231281 | 5/1963 | Australia | 128/202.13 |

*Primary Examiner*—Max Hindenburg
*Assistant Examiner*—J. P. Lacyk
*Attorney, Agent, or Firm*—Hovey, Williams, Timmons & Collins

[57] ABSTRACT

A porous bag filled with relatively small, loose, oil coated polystyrene beads permits sufficient air intake and adequately prevents smoke inhalation when placed over the nose and mouth while in most smoky atmospheres.

4 Claims, 1 Drawing Sheet

SAFETY PILLOW FOR PREVENTING SMOKE INHALATION

BACKGROUND OF THE INVENTION

This application is a continuation of application Ser. No. 891,567, filed Aug. 7, 1986, now abandoned which is a continuation-in-part of U.S. patent application Ser. No. 06/770,990, filed Aug. 30, 1985 now abandoned.

One of the major causes of death and injury during fires is smoke inhalation. Thus, there is a dire need for the inexpensive safety device embodying our present invention taking the form of a small, portable, air permeable pillowlike covering for the nose and mouth.

It includes a porous container of soft, flexible, oil absorbent material, e.g., a fabric, which envelops a dust free quantity of loose, relatively small bodies chosen from a synthetic plastic.

The bodies are lightly coated with an oily substance that is neither highly volitile nor readily combustible. The coating substance is selected from any one of the many vegetable oils, animal fats and petroleum which have a moderate viscosity and stickiness. In preferred forms, the coating substance comprises a mineral oil exhibiting long shelf life and resisting any tendency to wick onto the porous, fabric container.

In one embodiment of the invention, the bodies which are lightly coated within the porous container are comprised of small, polystyrene beads of a particular size range which enables the mask to readily conform to the contour of the face while providing sufficient surface area for contact with the contaminated air flowing through the bag during use. The lightweight nature of the beads causes the same to shift slightly by means of the air flowing through the container to more readily conform to the users face while presenting a maximum of oil-coated surface area for absorption of particulates, carbon monoxide as well as other toxic gases. Provision of a mixture of size ranges of these beads enables the bodies to shift to form a tightly packed configuration without undue restriction of the air passing therethrough in order that the wearer does not experience difficulty in inhaling sufficient quantities of oxygen.

Unexpectedly, it has been found that mineral oil of a certain viscosity when mixed with small bodies comprised of polystyrene will evenly coat the same and not tend to dissipate or otherwise run off from the bodies. When coated, the polystyrene bodies have a consistency somewhat like cottage cheese but yet are sufficiently lightweight and freely shiftable within the container to conform to the face and provide sufficient surfce area for the passing contaminated air with a minimum of pressure drop, so that the wearer under normal use should not experience undue pressure resistance to breathing while escaping from the smoke or fire.

Therefore, the device is light in weight and adapted to be placed in use easily and quickly should the need arise. Sufficient air flows through the bag and its filler during natural breathing without substantial risk of asphyxiation inasmuch as intake of smoke into the lungs is adequately eliminated.

An elastic headband is provided to maintain the device in place, and a strong, impermeable case therefor retains excess oil drainage. The case has a closure which can be easily and rapidly opened during emergencies.

Our attention has been called to the following U.S. Pat. Nos.:

443,191 Illing Dec. 23, 1890
533,854 Loeb Feb. 5, 1895
695,403 Longden Mar. 11, 1902
904,287 Warham Nov. 17, 1908
2,261,362 Gill Nov. 4, 1941
2,708,932 Pipher May 24, 1955
2,865,466 Frohmader Dec. 23, 1958
3,107,986 Plaut, et al. Oct. 22, 1963
3,284,361 Rocchini Nov. 8, 1966
3,807,144 Graybill Apr. 30, 1974

We are also aware of Austria No. 231,281.

The instant invention relates to the "Smoke Inhalation Safety Device" of U.S. Pat. No. 4,402,317, issued to Roy E. Martin on Sept. 6, 1983.

DESCRIPTION OF THE PREFERRED EMBODIMENT

A pillow-like, metal free, protective device 10 may be on any desired size and shape although one having about a 10" by 10" peripheral dimension with approximately a 4" maximum thickness has been found to be quite satisfactory for the contemplated use thereof as hereinbelow to be fully explained.

Figure 2:
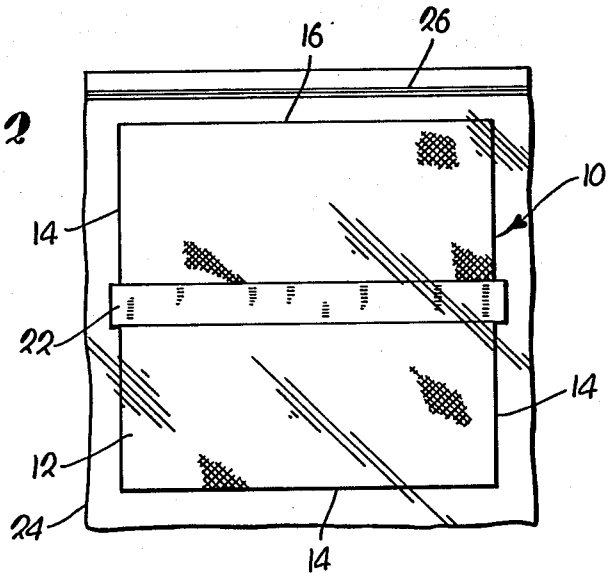
FIG. 2 is an enlarged, elevational view of the back of the device shown within a storage case.
Figure 4:
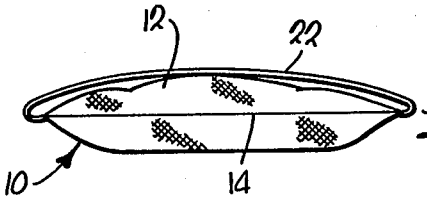
FIG. 4 is an edge view thereof.
Figure 5:
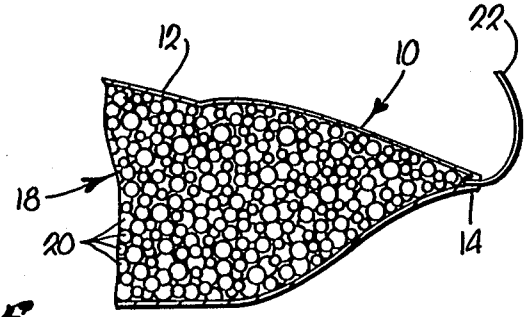
FIG. 5 is a fragmentary, cross-sectional view thereof still further enlarged.
Figure 1:
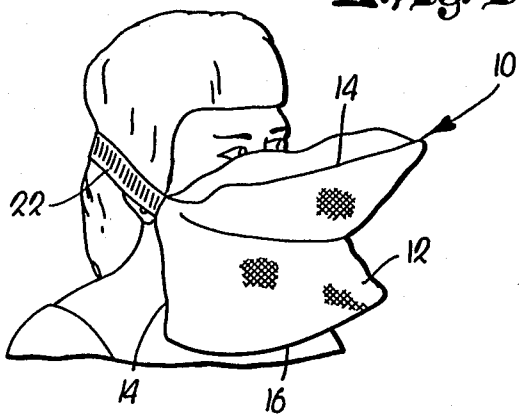
FIG. 1 is a perspective view of a smoke inhalation safety device made in accordance with our present invention shown in place over the mouth and nose of the user.
Figure 3:
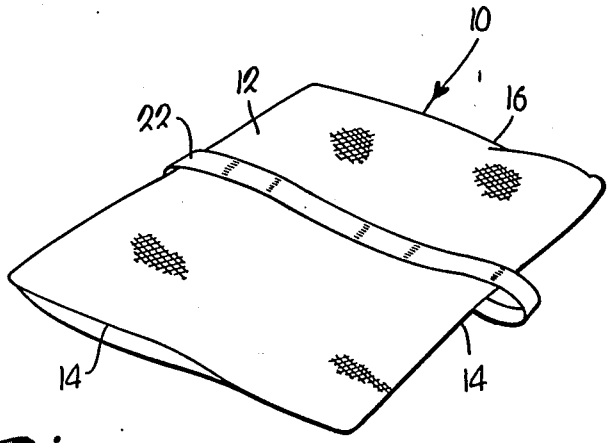
FIG. 3 is a rear perspective view of the device removed from its case.

The device 10 includes a container 12 which may be made from an oil absorptive cloth such as to be flexible, sufficiently permeable for flow of air therethrough and have a soft, smooth, delicate outer surface to thereby conform to the shape of the face and not be irritating to the skin when placed over the nose and mouth as shown in FIG. 1. The container 12 is fully closed as by marginal stitching 14 along its periphery except at a line of fold 16. The pores or interstices of the cloth for the container are desirably not more than 1/64" in size.

A filling 18 of relatively small, discrete bodies 20 is loosely enveloped in the container 12, care being taken to eliminate as much as possible any substantial amount of dust and other fine or pulverized particles. It is desirable that the bodies 20 be in the nature of a multitude of individual, loose, thermoplastic elements of conical or ovoidal shape, but preferably spherical or of comparable round or roundish, ball-shaped configurations. To this end, we contemplate the use of polystyrene beads readily available on the open market.

When the bodies 20 are comprised of generally spherical polystyrene beads, good results have been observed when the diameter of the beads is within the range of 0.01 inch to 0.50 inch. Better results, however, have been observed when the diameter of the spherical polystyrene bodies 20 is within the range of 0.02 inch to 0.25 inch. Best results have been obtained when the diameter of the spherical polystyrene bodies 20 is within the range of 0.0313 inch to 0.125 inch. In one test, very good results were observed when a mixture of size ranges was employed, which comprised three parts by volume of generally spherical polystyrene beads having a diameter of 0.0625 inch to 0.125 inch and one part by volume of generally spherical polystyrene beads having a diameter of 0.0313 inch to 0.0625 inch.

To preclude drying of the bodies 20 and to maintain dust (if any) within the container 12, they are coated with a substance which has an oily consistency. The oil should be agreeable to the senses and devoid of any unpleasant odor. To be avoided is the use of oils which might be irritating to the nostrils, throat, mouth and skin. Moreover, spraying of the oil onto the bodies 20 in avoidance of an excess is preferred to saturation. The oiled bodies 20 should then be well drained before filling into the porous bag-like container 12. Therefore, the oily substance to be used is preferably oils which are moderately viscous and sticky.

Preferably, the oily substance coating the bodies 20 is comprised of a white mineral oil having a viscosity ranging from 60 to 1,000 at 100 degrees Fahrenheit. Good results have been obtained using mineral oil sold under the brandname TUFFLO, no. 6056, by Atlantic Richfield Company, which has a viscosity of 475 at 100 degrees Fahrenheit. This particular mineral oil exhibits long shelf life and does not wick onto the container 12 when the latter is comprised of a polyester material. Moreover, such a mineral oil will not become rancid as will vegetable oils after a period of time.

While the device 10 may be held by hand in the position shown in FIG. 1, both hands are freed by use of an elastic headband 22 having its ends secured to the container 12 by the stitching 14.

When not in use, the device 10 may be stored in an oil impermeable case 24 made, for instance, from plastic and having a releasable closure 26 along one marginal edge. Snap-in types of tongue and groove closures 26, readily available on the open market, are quite satisfactory.

OPERATION

It is to be suggested that one or more of the devices 10 be kept readily accessible in every household wherever fire is likely to originate or spread, as in the basement, in the kitchen and adjacent each bedstead. Each hotel room, office, store and other public establishment might well provide the devices 10 as a precaution and safety measure. Any tendency for oil to leak beyond the container 12 might soil contents of travel bags were it not for the case 24, it certainly being one important recommendation that protection away from the home be kept in mind by owners of our devices 10.

When needed, the device 10 is simply held in place or worn in the manner shown by FIG. 1. The user breathes quite naturally until able to exit the smoke filled atmosphere, all the while in freedom of inhalation of the smoke through the container 12 and the filling 18.

Use of the preferred size ranges set forth here inabove for the bodies 20 when the latter are comprised of polystyrene beads has proved to be highly efficient means for filtering contaminates from a smoke filled environment when the deivce 10 is placed over the wearers face. In particular, the lightweight nature of polystyrene bodies of these preferred size ranges enables the beads to readily shift when the device 10 is initially placed in use, and thereafter remain relatively stationary for the remainder of the period of use. The particular size ranges, and specifically the disclosed 3-to-1 mixture size ranges for the polystyrene beads 20 causes the latter to readily and easily become tightly packed into a configuration which maximizes the surface area of the oiled bodies 20 to the air passing through the device 10 without unduly restricting the flow of air at pressures that are normally present in use and at air flow volumes normally experienced by the device 10 when placed against the human face. The preferred, disclosed size ranges of the bodies 20 also has been found to reduce any tendency of the air to bypass the oiled surfaces and arrive at the wearer's face without sufficient filtering. Furthermore, it has been found that the polystyrene beads of the preferred size ranges set forth above along with the coating substance of mineral oil effectively filter carbon monoxide from the air passing through the deivce 10 and increase the likelihood that the wearer will safely escape from the smoke filled atmosphere, since carbon monoxide is highly toxic in such environments.

Additionally, when the container 12 is filled with mineral oil coated bodies 20 comprised of polystyrene beads of the preferred size ranges disclosed above, wherein approximately 170 to 200 cubic inches of oiled beads are placed within the container 12, the device 10 weighs no more than 4 ounces and can be readily held in place by the elastic headband 22. Noteworthy also is the fact that a parent can place one side of the device against his or her face and carry a small child in such a position that the child's face is pressed against the other side of the device 10, such that both the parent and child can breathe through the device 10 as each side of the latter individually conforms to both the face of the child and of the parent, providing effective, economical protection for more than one individual during a smoke emergency situation.

In one conducted test of the invention, using bodies 20 of the prefered 3-to-1 size mixture, 91 to 98 of the particulate matter was removed by the device 10 at air flow rates approximating the human breathing rate, wherein the contaminated air was generated by combusting a mixture of wood, fabric, carpeting scrapes and synthetic resinous material to simulate a residential or commercial fire. In the same text, carbon monoxide removal ranged from 58 to 76%, values much higher than expected.

We claim:

1. A yieldable, metal free covering adapted to readily conform to the shape of the face when placed across the face against the nose and mouth and use while breathing therethrough in a smoky atmosphere to protect the respiratory system against undue smoke inhalation, said covering comprising:

a closed, pillow-like bag of soft, flexible, air permeable material; and a filling of relatively small, loose, discrete, individually shiftable, substantially dust free, bodies enveloped in said bag, said bodies comprised of a synthetic resinous material, said bodies being incapable of inhalation from the bag during said breathing and being lightly coated with a substance having an oily consistence, said substance being selected from the group which consists of derivatives of petroleum, animal fats and plant, said substance being a liquid at room temperature, said bodies being substantially roundish and generally spherical and, wherein the diameters of the bodies comprise a mixture of sizes with three parts by volume of diameters within the range of from 0.125 inch to 0.0625 inch and one part by volume of bodies having diameters within the range of from 0.0625 inch to 0.0313 inch.

said bodies being shiftable within said bag during initial placement of said covering across the face of the user for rolling and self-shifting of the bodies to a tightly packed configuration and for conforming to the user's face while permitting airflow therethrough.

2. The invention as set forth in claim 1, wherein said bodies are beads of polystyrene.

3. The invention as set forth in claim 2, said substance is a mineral oil having a viscosity in a range of 60 to 1,000 at 100 degrees Fahrenheit.

4. The invention as set forth in claim 3, wherein said viscosity of said mineral oil is approximately 475 at 100 degrees Fahrenheit.

* * * * *